US008528783B2

(12) United States Patent
Pritchard

(10) Patent No.: US 8,528,783 B2
(45) Date of Patent: Sep. 10, 2013

(54) STERILE DISPENSING PACKAGE WITH COUPLING INSERT FOR RECEIPT OF PIERCING MEMBER AND METHOD OF USING THE SAME

(75) Inventor: Barry Pritchard, Nazareth, PA (US)

(73) Assignee: Fres-co System USA, Inc., Telford, PA (US)

( * ) Notice: Subject to any disclaimer, the term of this patent is extended or adjusted under 35 U.S.C. 154(b) by 1199 days.

(21) Appl. No.: 12/413,759

(22) Filed: Mar. 30, 2009

(65) Prior Publication Data

US 2010/0243671 A1 Sep. 30, 2010

(51) Int. Cl.
*B67D 5/00* (2006.01)

(52) U.S. Cl.
USPC ..... 222/83; 222/541.2

(58) Field of Classification Search
USPC ..... 222/80–89, 105, 541.2, 569, 107; 215/250, 344; 141/114, 329; 383/202
See application file for complete search history.

(56) References Cited

U.S. PATENT DOCUMENTS

| | | | | |
|---|---|---|---|---|
| 3,807,597 | A * | 4/1974 | Wells et al. | 220/277 |
| 4,165,023 | A * | 8/1979 | Schmit | 222/105 |
| 4,325,496 | A * | 4/1982 | Malpas | 222/83 |
| 4,603,793 | A | 8/1986 | Stern | |
| 4,776,488 | A | 10/1988 | Gurzan | |
| 5,407,099 | A | 4/1995 | Heuke et al. | |
| 5,464,123 | A * | 11/1995 | Scarrow | 222/83.5 |
| 5,730,327 | A | 3/1998 | Stern | |
| 5,967,368 | A * | 10/1999 | Guillermier | 222/81 |
| D418,413 | S | 1/2000 | Stern | |
| 6,082,584 | A | 7/2000 | Stern | |
| 6,098,845 | A | 8/2000 | Stern | |
| 6,109,315 | A | 8/2000 | Stern | |
| 6,227,410 | B1 * | 5/2001 | Stern | 222/1 |
| 6,257,844 | B1 | 7/2001 | Stern | |
| D464,262 | S | 10/2002 | Drennow | |
| 6,460,732 | B1 | 10/2002 | Drennow | |
| 6,802,436 | B2 | 10/2004 | Drennow et al. | |
| 6,860,407 | B2 | 3/2005 | Gosselin | |
| 7,011,233 | B2 | 3/2006 | Drennow | |
| 7,040,554 | B2 | 5/2006 | Drennow | |
| 7,168,933 | B2 | 1/2007 | Stern | |
| 7,395,947 | B2 | 7/2008 | Drennow | |
| 7,584,870 | B2 | 9/2009 | Drennow | |
| 8,205,771 | B2 * | 6/2012 | Compton | 222/105 |
| 2004/0104246 | A1 * | 6/2004 | Kawaguchi et al. | 222/83 |

FOREIGN PATENT DOCUMENTS

| | | | |
|---|---|---|---|
| GB | 1104359 | * | 2/1968 |
| WO | 9510963 | | 4/1995 |
| WO | 0121292 | A1 | 3/2001 |

(Continued)

*Primary Examiner* — Paul R Durand
*Assistant Examiner* — Robert Nichols, II
(74) *Attorney, Agent, or Firm* — Caesar, Rivise, Bernstein, Cohen & Pokotilow, Ltd.

(57) ABSTRACT

A package for dispensing a flowable material is disclosed. The package includes an interior chamber for holding the flowable material, a coupling insert located within the chamber and a piercing member. The piercing member includes a dispensing tube and is arranged to pierce through the package to communicate with the chamber and thereafter to snap-connect to the coupling insert. The contents of the package can then be dispensed from the package via the dispensing tube. The coupling insert is arranged to be moved to any desired position within the chamber. The package's wall may be constructed, e.g., be transparent and/or include target indicia thereon, to facilitate the positioning of the coupling insert at the desired position.

11 Claims, 4 Drawing Sheets

(56) References Cited

FOREIGN PATENT DOCUMENTS

| | | | |
|---|---|---|---|
| WO | 0226586 | A1 | 4/2002 |
| WO | 03004402 | A1 | 1/2003 |
| WO | 2004037667 | A1 | 5/2004 |

* cited by examiner

STERILE DISPENSING PACKAGE WITH COUPLING INSERT FOR RECEIPT OF PIERCING MEMBER AND METHOD OF USING THE SAME

BACKGROUND OF THE INVENTION

This invention relates to valves and more particularly to flexible packages and more particularly to aseptic (sterile) flexible packages for dispensing flowable materials.

Several U.S. patents disclose flexible packages, i.e., packages including a flexible wall, adapted for holding a flowable, e.g., liquid or semi-liquid, product. Those packages include an inner coupling device that is located within the interior of the package adjacent an unopened portion of the package's flexible wall. An outer coupling device, typically in the form of a piercing device, is provided and arranged to be connected to the inner coupling device with a portion of the wall of the package interposed therebetween so that it can be pierced to provide access to the interior of the package. In particular, when the two coupling devices are connected together a piercing portion of the outer coupling device pierces through an interposed unopened portion of the wall of the package, whereupon the flowable material can be dispensed from the package. For example, U.S. Pat. No. 4,603,793 (Stern) discloses a flexible package wherein the perforation of the package's flexible wall is carried out simultaneously with the interconnection of the inner and outer coupling devices. Owing to the construction of that device, leakage may occur in some instances during the connection/perforating step. U.S. Pat. No. 6,098,845 (Stern) attempts to address the leakage problem of the device of the '793 Stern patent. To that end the '845 Stern patent discloses a package including an inner coupling device located within the package and an outer coupling device or perforator. Unlike the device of the '793 Stern patent the outer coupling device of the '845 Stern patent does not make the hole in the wall of the package when the two coupling devices are interconnected, but makes that hole after the interconnection of the inner and outer coupling devices. U.S. Pat. No. 6,082,584 (Stern) and U.S. Pat. No. 6,227,410 (Stern) disclose other flexible packages wherein the piercing of the flexible package is effected after the inner and outer coupling devices are interconnected.

Other patents disclosing flexible packages including inner and outer coupling devices for effecting the perforation of the wall of the package to provide access to the package's interior are: U.S. Pat. No. 4,776,488 (Gurzan); U.S. Pat. No. 5,407,099 (Heucke et al.); and U.S. Pat. No. 6,460,732 (Drennow).

While the aforementioned devices may be generally suitable for their intended purposes they nevertheless leave something to be desired from one or more various standpoints, simplicity of construction, ease of use, and resistance to leakage. The subject invention addresses those needs.

SUMMARY OF THE INVENTION

One aspect of this invention entails a package for enabling the dispensing a flowable material therefrom. The package basically comprising a piercing member, an interior chamber, and a coupling insert located within the chamber. The chamber is arranged for receipt of a flowable material and comprises a wall formed of a flexible sheet material. The piercing member comprises a piercing tip, a conduit in fluid communication with the piercing tip and a sealing skirt. The coupling insert has a wall-engaging surface and an opening contiguous with the wall-engaging surface that is in communication with the interior chamber. The piercing member and the coupling insert are arranged to be moved with respect to each other to cause the piecing tip to engage the wall of the package and pass therethrough as the sealing skirt engages a portion of the wall of said package around the piercing tip. The piercing member and the coupling insert are snap-connectable to each other after the piercing tip has pierced the wall of the package, whereupon the piercing member and the coupling insert are secured together, with the conduit of the piercing member in fluid communication with the interior chamber.

In accordance with another aspect of this invention a method of dispensing a flowable material from a flexible package is provided. That method entails providing a dispensing package having a wall formed of a flexible material, an interior chamber contiguous with the wall of the package and a coupling insert disposed within the chamber. The dispensing package has a flowable material in its interior chamber. The coupling insert comprises a wall-engaging surface and an opening in the wall-engaging surface that is in communication with the interior chamber. A piercing member is provided and comprises a piercing tip, a conduit in fluid communication with the piercing tip and a sealing skirt. The dispensing package and the piercing member are moved with respect to each other to cause the piercing tip to penetrate the wall of the package to enter into the opening in the wall-engaging surface of the coupling insert as the sealing skirt engages a portion of the wall of the package between it and said wall-engaging surface of the coupling insert. After that has occurred the piercing member and the coupling insert are snap-fit together with the conduit of said piercing member in fluid communication with the interior chamber.

DETAILED DESCRIPTION OF THE PREFERRED EMBODIMENT

Figure 1:
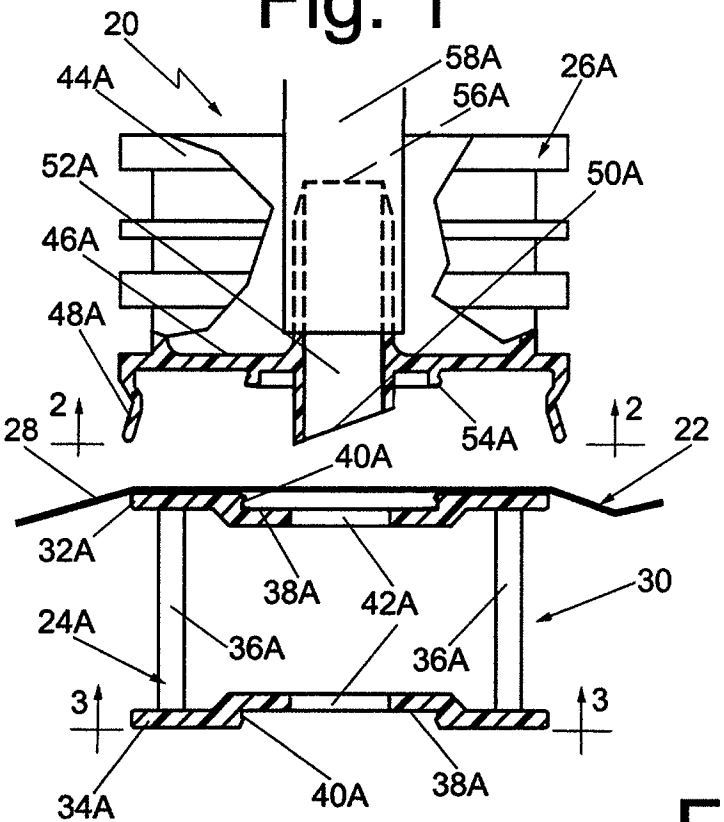
FIG. 1 is an exploded view, partially in section, of one exemplary embodiment of a flexible dispensing package including a piercing member and a coupling insert constructed in accordance with this invention shown at a preliminary step in the assembly of the package to enable the package to dispense its contents.
Figure 5:
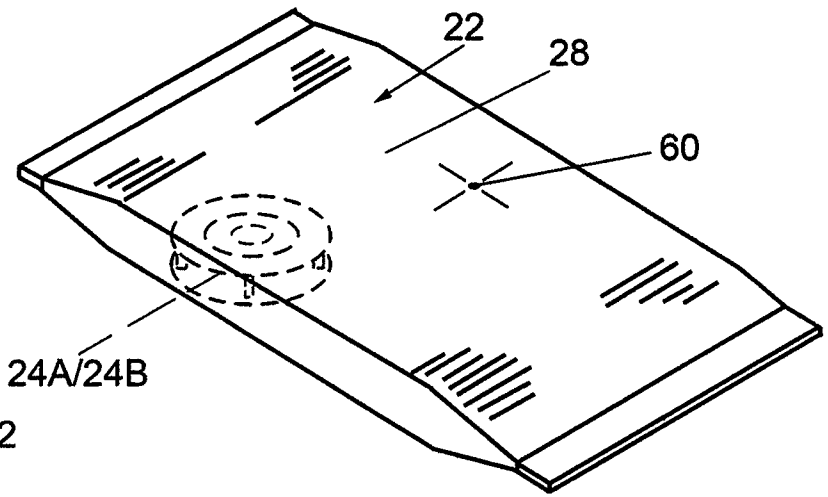
FIG. 5 is a reduced isometric view the package of FIG. 1 with the coupling insert located therein, but shown before the connection of the piercing member thereto.
Figure 7:
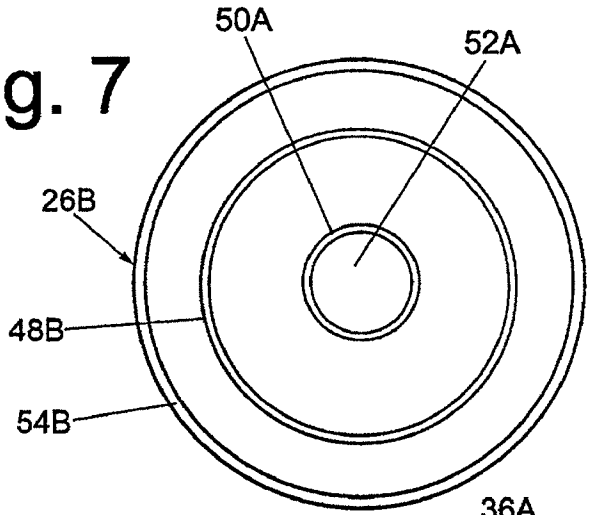
FIG. 7 is a top plan view taken along line 7-7 of FIG. 6 showing the piercing end of the piercing member.
Figure 8:
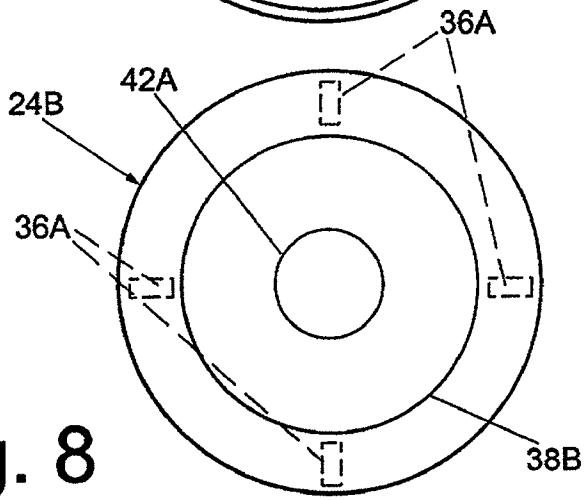
FIG. 8 is a top plan view taken along line 8-8 of FIG. 6 showing one end of the coupling insert.
Figure 6:
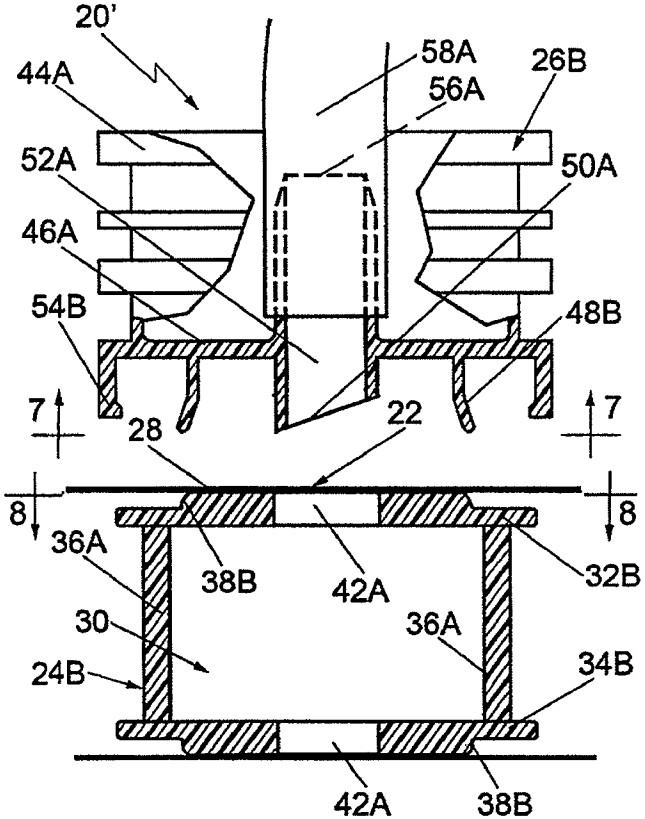
FIG. 6 is view similar to FIG. 1, but showing an alternative embodiment of a package constructed in accordance with this invention.
Figure 9:
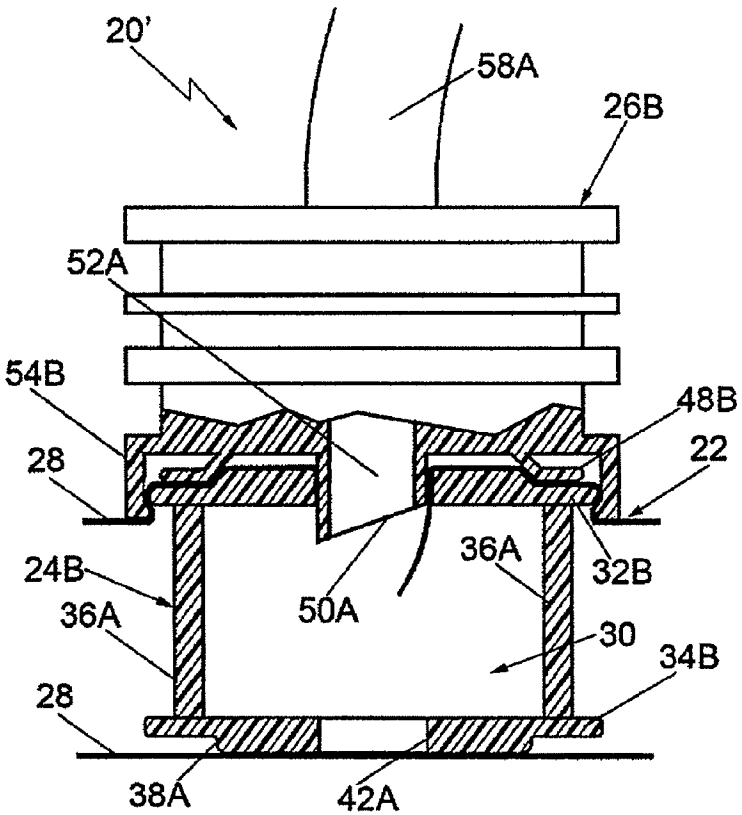
FIG. 9 is a partial sectional view showing the package of FIG. 6 after it has been assembled, i.e., the piercing member connected to the coupling member with a portion of the wall of the package interposed therebetween.

Referring now to the various figures of the drawing wherein like reference characters refer to like parts, there is shown at 20 in FIG. 1 and at 20' in FIG. 6 respective exemplary embodiments of flexible packages constructed in accordance with this invention. Each package is arranged to be pierced by a piercing member forming a portion of the package to provide access to the interior of the package so that flowable material located within the interior of the package can be dispensed. The actual dispensing of the flowable material from the package is typically accomplished by use of a dispensing apparatus (not shown) into which the package is inserted. Thus, as can be seen in FIGS. 1, 5 and 6 each of the packages of this invention basically comprise a hollow body 22 (FIG. 5), an internally located coupling insert 24A (FIGS. 1, 3, 4 and 5) and 24B (FIGS. 6, 8 and 9) and a piercing member 26A (FIGS. 1, 2 and 4) and 26B (FIGS. 6, 7 and 9). The piercing member is adapted to pierce a portion of the wall of the package between it and the internally located coupling insert to provide access to the interior of the package. Moreover the piercing member and the coupling are arranged to be snap-connected together after the package's wall has been pierced to hold the components together so that the flowable contents of the package can be withdrawn or dispensed through the piercing member.

It should be pointed out at this juncture that this invention contemplates a variety of types of packages, e.g., "pillow" type pouches (rectangular or otherwise shaped) like that shown in FIG. 5, stand-up pouches (i.e., pouches having a bottom gusset to produce a self-standing geometry), parallelepiped (e.g., "brick-shaped") gusseted packages, etc. Irrespective of the shape of the package, the body of each package comprises plural walls 28 formed of a flexible sheet material and which bound an interior chamber 30 in which a flowable product is located.

The packages of this invention are particularly suited for holding flowable foodstuffs, e.g., liquids, pasty materials, etc., or other products which need to be maintained under aseptic conditions until they are ready to be dispensed. To that end, the material(s) making up the package's walls 28 can be either a single ply or multiple plies of any conventional flexible packaging material suitable for that purpose.

As best seen in FIGS. 1 and 5, and as mentioned above, the coupling insert 24A is located within the package's hollow interior (chamber) 30. In accordance with one preferred aspect of this invention the coupling insert 24A is freely movable within the chamber 30, but may, if desired be affixed to the inner surface of any desired portion of a wall 28 of the package bounding the chamber. With the coupling insert being freely movable within the package, the user can position it to any desired position in the package to serve as a backstop for the piercing member, i.e., to enable the package to be pierced by the piercing member at that particular desired position. This enables the packages of this invention to be used with a wide variety of conventional apparatus or machines for dispensing the contents of the packages.

Figure 3:
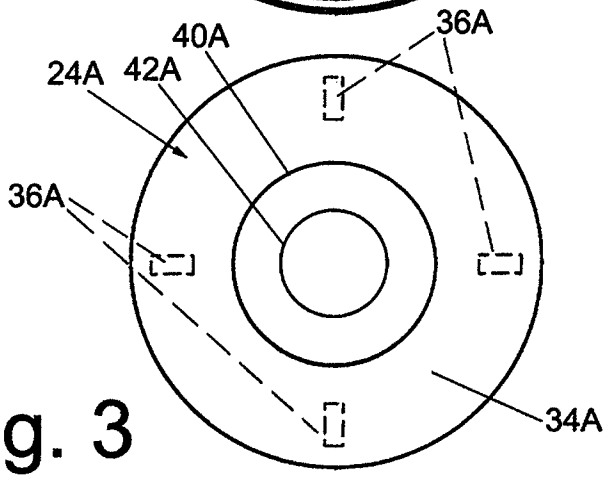
FIG. 3 is a top plan view taken along line 3-3 of FIG. 1 showing one end of the coupling insert.
Figure 4:
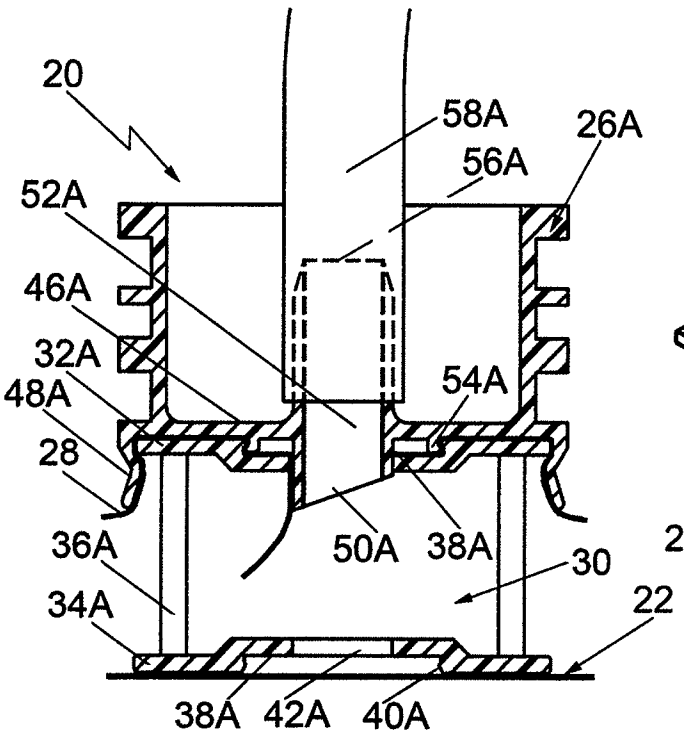
FIG. 4 is a partial sectional view showing the package of FIG. 1 after it has been assembled, i.e., the piercing member connected to the coupling member with a portion of the wall of the package interposed therebetween.

Referring now to FIGS. 1, 3 and 4 the details of the coupling insert 24A will now be described. The coupling insert is arranged to act as a backstop against which the piercing member can be pressed to effect the piercing of the wall of the package. As can be seen the coupling insert 24A basically comprises a pair of circular disk-like plates 32A and 34A which are disposed parallel to each other by four equidistantly spaced struts 36A. The central portion of each of the disk-like plates is inwardly offset to form an undercut circularly shaped recess 38A, i.e., the annular surface 40A surrounding the recess 38A is undercut. The undercut recess 38A is arranged to be snap-connected to an interrupted annular wall (to be described later) forming a portion of the piercing member 26 to connect the piercing member to the internally located coupling insert after the wall of the package has been pierced to thereby hold those components together (as will be described later). A circular opening or hole 42A extends through the center of the recess 36A to receive a piercing tip (to be described later) of the piercing member. In accordance with a preferred aspect of this invention the coupling insert 24A (as well as the coupling insert 24B to be described later) is an integral or unitary member and can be formed in any way, e.g., molded of a plastic or any other material suitable for contact with the product to be held within the package's chamber 30.

Figure 2:
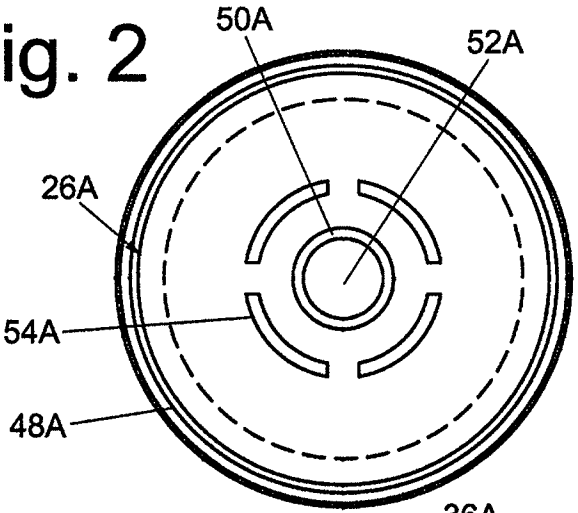
FIG. 2 is a top plan view taken along line 2-2 of FIG. 1 showing the piercing end of the piercing member.

Turning now to FIGS. 1, 2 and 4 the details of the piercing member 26A will now be described. As can be seen that member basically comprises a cup-shaped body 44A having a planar lower end wall 46A. An annular skirt 48A projects outward from the periphery of the end wall 46A. The skirt is somewhat flexible to form a seal with a portion of the wall of the package (as will be described later) to prevent the leakage of the flowable material from the package as the piercing operation occurs and before the piercing member and the coupling insert are snap-connected together. The free edge of the skirt 48A is flared and arranged to receive the peripheral edge of either of the circular plates 32A or 34A of the coupling insert 24A with a portion of the wall 28 of the package interposed therebetween (as will also be described later). This flaring configuration serves to guide or center the piercing member with respect to the coupling insert to facilitate the piercing of the package.

The piercing of the package is accomplished specifically by means of a piercing tip 50A. The piercing tip 50A is a tubular member that projects outward from the center of the end wall 46A and has a central passageway 52A extending through it. The free end of the tubular piercing tip is in the form of a sharp angularly extending cutting edge. The tubular piercing tip 50A is arranged to be received within the central opening or hole 42A in the coupling insert when the package is to be pierced. To that end, the internal diameter of the hole 42A is approximately the same size or slightly larger than the external diameter of the piercing tip.

The piercing of the wall of the package is accomplished as follows. The coupling insert is moved to the desired position within the sealed package so that the outer surface of either of its plates 32A or 34A engages the inner surface of the wall of the package at the desired location for the penetration. The piercing member is then moved toward the package's body 22 as shown in FIG. 1 until the free sharpened end of the piercing tip engages the portion of the wall of the package disposed directly over the hole 42A in the coupling insert. At the time that this occurs the sealing skirt makes contact with the wall of the package to prevent leakage of the flowable material (as will be described later). Continued movement of the piercing member toward the coupling member causes the piercing tip to cut and pass through the wall of the package until the piercing tip and the coupling insert are snap-fit together as shown in FIG. 4. This action creates a hole in the wall of the package, e.g., a portion of the wall of the package will be cut away to form a flap extending into the interior of the package, through which the piercing tube extends. The hollow interior passageway 52A of the piercing tip now extends through the hole 42A in the coupling insert and is in fluid communication with the interior (chamber 30) of the package, i.e., the flowable material within the chamber.

As mentioned earlier, the piercing member 26A is arranged to be snap-connected to the coupling insert 24A after the piercing of the package has occurred. That connection action is accomplished by means of an interrupted annular wall 54A. That wall projects from the piercing member's end wall 46A and extends about the piercing tip 50A. The interrupted annular wall 54A is arranged to be snap-fit within the circular recess 38A in either of the plates 32A or 34A of the coupling insert 24A as shown in FIG. 4. To that end, the outer surface of the interrupted annular wall 54A is of a complementary shape to the under cut surface 40A of the recess 38A. The height of the interrupted annular wall 54A is significantly shorter than the length of the piercing tip 50A to ensure that the piercing of the interposed wall 28 of the package 20 by the piercing tip occurs before the interrupted annular wall 54A snap-connects into the undercut recess 38A.

Since the wall 28 of the package will be pierced before the piercing member and the coupling insert are connected together, the annular skirt 48A is dimensioned to engage a portion of the wall of the package as soon as the piercing tip engages the wall of the package. The periphery of the annular skirt thus forms a seal preventing leakage of the flowable product from the package. To that end, the free edge of the sealing skirt is at least coplanar with the free end of the piercing tip, and can even extend slightly therebeyond (in which case the sealing skirt will engage the wall of the package before piercing begins).

As will be appreciated by those skilled in the art, since the sealing skirt 48A is somewhat flexible and its free edge is flared, the skirt will flex outward as it engages the wall 28 of the package so that it rides over the periphery of either of the plates 32A or 34A of the coupling insert and then snaps back to trap the wall of the package between it and the associated plate 32A or 34A. At substantially the same time the interrupted annular wall 54A will have snap-fit into the recess 38A in that associated plate as shown in FIG. 4. Accordingly, the piercing member 26A will be secured to the coupling insert 24A by the snap-connection of its interrupted annular wall 54A in the recess 38A as well as the snap-fitting of the sealing skirt 48A about the periphery of the associated plate 32A or 34A. The tight interposition of the package's wall 28 between those members ensures that the flowable contents of the package cannot leak out of the connection.

The flowable material within the package is arranged to be withdrawn or dispensed from the package via the passageway 52A in tubular piercing tip 50A. To that end, another tubular member 56A extends from the end wall 46A opposite to the piercing tip 50A. The central passageway 52A of the tubular piercing tip extends through the tubular member 56A. A flexible dispensing tube 58A is arranged to be secured to the tubular member 56A, i.e., the tubular member is frictionally fit within an end of the dispensing tube 58A. The free end (not shown) of the flexible dispensing tube is closed, e.g., sealed, so that the contents of the package can not flow out of that tube until such action is desired. The opening of that tube can be accomplished by cutting off the sealed portion when the package is ready to be inserted into the dispensing apparatus. As mentioned above, the piercing device includes a cup-shaped body 44A. As can be seen in FIGS. 1 and 4 that body includes a plurality of externally located annular rings or flanges, which may be utilized to mount or dispose the package 20 within the dispensing apparatus.

The positioning of the coupling insert at a desired position within the package to enable the piercing member to pierce the package at that position can be facilitated in various ways. For example, as shown in FIG. 5, the package may include one or more target indicia 60 printed on the package and serving as the desired location for the penetration of the package. All that is required of the user of the package is to move the coupling insert to those indicia. Since the walls of the package are flexible one can readily determine the location of the coupling member by feel. Moreover, if desired the package may be formed of a transparent or translucent material to enable the visualization of the internally located coupling insert so that it can be readily moved to its desired position. As mentioned above, if desired, the coupling insert can be fixedly secured to the inner surface of the package at a desired location so that the package can be pierced at only that location.

Referring now to FIGS. 6-9, there is shown a second embodiment of a package 20' constructed in accordance with this invention. The package 20' makes use of the heretofore coupling insert 24B and the heretofore identified piercing member 26B. It should be pointed out at this juncture that packages other than those specifically shown and described herein are contemplated. Various features of the package 20' shown in FIGS. 6-9 are identical to those of the package 20 of FIGS. 1-5. In the interest of brevity those components that are common to both of the packages will be given the same reference numbers and a description of their construction and operation will not be reiterated. Thus, as can be seen the coupling insert 24B basically comprises a pair of circular disk-like plates 32B and 34B which are disposed parallel to each other by four equidistantly spaced struts 36A. The central portion of each of the disk-like plates is in the form of a raised circular mesa 38B. A circular opening or hole 42A extends through the center of the mesa 38B to receive the piercing tip of the piercing member 26B.

The piercing member 26B basically comprises the cup-shaped body 44A having a planar lower end wall 46A. An annular skirt 48B projects outward from the end wall 46A and extends around the piercing tip 50A. The skirt is somewhat flexible to form a seal with a portion of the wall of the package (as will be described later) to prevent the leakage of the flowable material from the package as the piercing operation occurs and before the piercing member and the coupling insert are snap-connected together. The free edge of the skirt 48B is flared and arranged to receive the periphery of the circular mesa 38B of either of the circular plates 32B or 34B of the coupling insert 24B with a portion of the wall 28 of the package interposed therebetween (as will also be described later). This flaring configuration serves to guide or center the piercing member with respect to the coupling insert to facilitate the piercing of the package.

The piercing of the package is accomplished by means of the piercing tip 50A which is arranged to be received within the central opening or hole 42A in the coupling insert 24B when the package 20' is to be pierced. To that end, the internal diameter of the hole 42A is approximately the same size or slightly larger than the external diameter of the piercing tip 50A.

The piercing of the wall 28 of the package 20' is accomplished as follows. The coupling insert 24B is moved to the desired position within the sealed package so that the outer surface of either of its plates 32B or 34B engages the inner surface of the wall of the package at the desired location for the penetration. The piercing member is then moved toward the package's body 22 as shown in FIG. 6 until the free sharpened end of the piercing tip 50A engages the wall of the package disposed directly over the hole 42A in the coupling insert. At the time that this occurs the sealing skirt 48B makes contact with the wall of the package to prevent leakage of the flowable material (as will be described later). Continued movement of the piercing member toward the coupling member causes the sealing skirt to flex outward while still engaging the wall of the package to maintain the seal and also the piercing tip to cut through the wall of the package at the opening until the piercing tip and the coupling insert are snap-fit together as shown in FIG. 9. This action creates a hole in the wall of the package, e.g., a portion of the wall of the package will be cut away to form a flap extending into the interior of the package, through which the piercing tube extends. The hollow interior passageway 52A of the piercing tip will now extend through the hole 42A in the coupling insert and will be in fluid communication with the interior of the package, i.e., the flowable material within the chamber 30.

Since the wall 28 of the package will be pierced before the piercing member and the coupling insert are connected together, the annular skirt 48B is dimensioned to engage a portion of the wall of the package as soon as the piercing tip engages the wall of the package to form a seal preventing leakage of the flowable product from the package. Thus, the free edge of the sealing skirt is at least coplanar with the free end of the piercing tip, and can even extend slightly therebeyond (in which case the sealing skirt will engage the wall of the package before piercing begins).

As mentioned earlier, the piercing member 26B is arranged to be snap-connected to the coupling insert 24B after the piercing of the package has occurred. That connection action is accomplished specifically by means of an annular wall 54B. That wall projects from the periphery of the piercing member's end wall 46A. The annular wall 54B is somewhat flexible and includes a slightly inwardly directed flange at its free end. The annular wall is arranged to be snap-fit around the periphery of either of the plates 32B or 34B of the coupling insert 24B as shown in FIG. 9.

As will be appreciated by those skilled in the art, since the annular wall 54B is somewhat flexible it will flex outward as it engages the wall 28 of the package so that it rides over the periphery of either of the plates 32B or 34B of the coupling insert and then snaps back to trap the wall of the package between it and the associated plate 32B or 34B. Accordingly, the piercing member 26B will be secured to the coupling insert 24B by the snap-fitting of the annular wall 54B about the periphery of the associated plate 32B or 34B. The tight interposition of the package's wall between those members ensures that the flowable contents of the package cannot leak out of the connection.

The flowable material within the package is arranged to be withdrawn or dispensed from the package via the passageway 52A which is coupled to the flexible dispensing tube 58A via the tubular member 56A.

Like usage of the package 20, the coupling insert 24B of the package 20' can be fixedly secured to the inner surface of the package 20' at a desired location so that the package can be pierced at only that location.

Without further elaboration the foregoing will so fully illustrate my invention that others may, by applying current or future knowledge, adopt the same for use under various conditions of service.

I claim:

1. A package for enabling the dispensing of a flowable material therefrom, said package comprising a piercing member, an interior chamber, and a coupling insert located within said chamber, said chamber being arranged for receipt of a flowable material and comprising a wall formed of a flexible sheet material, said piercing member comprising a sealing skirt, a piercing tip, and a conduit in fluid communication with said piercing tip, said sealing skirt having a flared free edge, said coupling insert having a peripheral edge and an opening in communication with said chamber, said piercing member and said coupling insert being arranged to be moved with respect to each other to cause said piercing tip to engage said wall of said package and pass therethrough as said flared free edge of said sealing skirt engages a portion of said wall of said package about said piercing tip, said flared free edge of said sealing skirt centering said coupling insert with respect to said piercing member, one of said piercing member and said coupling insert including an undercut wall and the other of said piercing member and said coupling insert including an undercut recess, said undercut wall and said undercut recess being arranged to effect a snap connection of said piercing member to said coupling insert after said piercing tip has pierced said wall of said package, whereupon said piercing member and said coupling insert are secured together, with said conduit of said piercing member in fluid communication with said opening in said coupling insert and with said chamber.

2. The package of claim 1 wherein said coupling insert is movably positioned within said interior chamber so that said opening in said insert can be juxtaposed into engagement with any desired portion of said wall of said package.

3. The package of claim 1 wherein said sealing skirt comprises an annular member arranged to engage said peripheral edge of said coupling insert with a portion of said wall of said package interposed therebetween.

4. The package of claim 3 wherein said sealing skirt is flexible and wherein said sealing skirt is snap-connectable to said peripheral edge of said coupling insert.

5. The package of claim 3 wherein said coupling insert is fixedly secured to a portion of the wall of said package.

6. The package of claim 1 wherein said coupling insert includes said undercut recess and said piercing member includes said undercut wall.

7. The package of claim 6 wherein said undercut wall comprises an interrupted annular wall.

8. The package of claim 1 wherein said coupling insert comprises an opposed pair of generally planar members spaced apart from each other, one of said members including said peripheral edge.

9. The combination of claim 1 wherein said package includes indicia on said wall at said desired portion to facilitate the positioning of said coupling insert at said desired position by a user of said package.

10. The combination of claim 1 wherein said wall of said package is constructed to enable said coupling insert to be visible therethrough.

11. The package of claim 1 wherein said coupling insert is fixedly secured to a portion of the wall of said package.

* * * * *